United States Patent [19]

Garfinkle

[11] Patent Number: 4,662,592

[45] **Date of Patent: * May 5, 1987**

[54] UNITARY PEGBOARD STABILIZER

[75] Inventor: Benjamin L. Garfinkle, Alameda, Calif.

[73] Assignee: Clamp Swing Pricing Co., Alameda, Calif.

[ * ] Notice: The portion of the term of this patent subsequent to Dec. 1, 1998 has been disclaimed.

[21] Appl. No.: 307,729

[22] Filed: Oct. 2, 1981

Related U.S. Application Data

[63] Continuation-in-part of Ser. No. 89,034, Oct. 29, 1979, Pat. No. 4,303,217.

[51] Int. Cl.[4] ..... E04G 5/06

[52] U.S. Cl. ..... 248/221.1; 248/225.2

[58] Field of Search ..... 248/221.1, 220.4, 221.2, 248/220.3, 223.3, 224.4, 225.2, 222.1; 211/192, 59.1

[56] References Cited

U.S. PATENT DOCUMENTS

| | | | |
|---|---|---|---|
| 3,037,732 | 6/1962 | Roman | 248/222.1 X |
| 3,193,231 | 7/1965 | Curry | 248/221.1 |
| 3,195,846 | 7/1965 | Dahlhauser | 248/221.1 |
| 3,591,117 | 7/1971 | Mazzetti | 248/226.1 X |
| 3,664,625 | 5/1972 | Price | 248/221.2 |
| 3,879,006 | 4/1975 | Stavdte | 248/221.2 |
| 3,891,172 | 6/1975 | Einhorn | 248/221.2 |

FOREIGN PATENT DOCUMENTS

| | | | |
|---|---|---|---|
| 243613 | 10/1962 | Australia | 248/221.2 |
| 1361087 | 7/1974 | United Kingdom . | |
| 2044078 | 10/1980 | United Kingdom . | |
| 2044079 | 10/1980 | United Kingdom . | |

*Primary Examiner*—J. Franklin Foss

*Attorney, Agent, or Firm*—Malcolm B. Wittenberg

[57] ABSTRACT

A unitary pegboard hanger assembly is disclosed which comprises a hanger protruding perpendicularly from a hook back plate, a hook member protruding on the opposite side thereof as the hanger, at least one protrusion perpendicular to the hook back plate on the same side thereof as the hook member and proximate thereto, and further characterized as being of such size and shape as to snugly fit into a pegboard hole together with the hook member.

1 Claim, 1 Drawing Figure

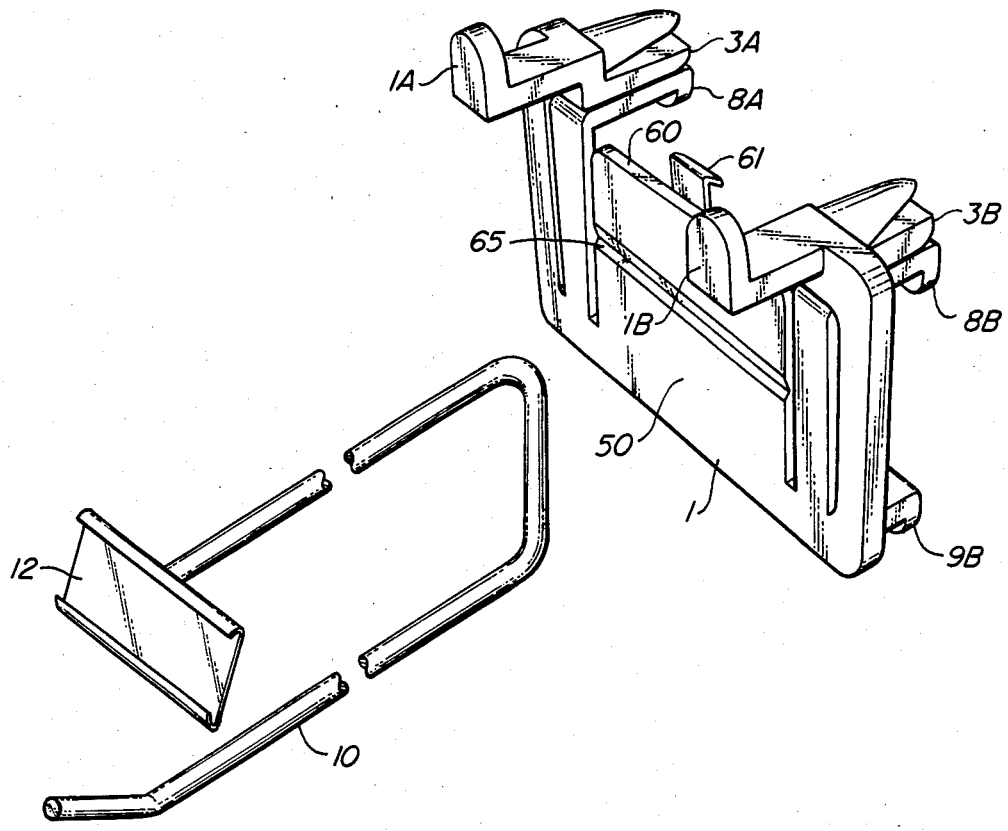
3A
1A
8A
60
61
3B
65
8B
1B
50
1
9B
12
10

UNITARY PEGBOARD STABILIZER

RELATED APPLICATION

This application is a continuation-in-part of U.S. application Ser. No. 089,034, now U.S. Pat. No. 4,303,217, filed on Oct. 29, 1979.

BACKGROUND OF THE INVENTION

Article supporting racks are commonly provided by the use of relatively rigid sheets of pegboard or the like perforated in a regular grid-like pattern so that supporting hangers in the form of hooks or brackets may be secured in various locations on the board by engaging an anchoring element of the hanger with a selected perforation in the board. Hangers for such use with pegboards take many different forms and shapes which are determined primarily by the nature of the articles that are to be supported thereby. Some of the most stable configurations are of the type where a rigid, vertical back plate having a hook for insertion within openings in the pegboard support horizontally extending article-supporting members. Within that broad description, article supporting members having a multi-hook back plate are even more rigid. For example, a dual-hook back plate having side-by-side hook members provide improved stability against horizontally applied forces being placed upon the load bearing member while dual-hook back plates having a first hook located above the second improves the stability of the assembly for the top hook provides a load bearing member for those items placed upon the hanger, while the lower hook helps to prevent the hanger assembly from being inadvertently lifted from the pegboard by an upward force. A four hook assembly combines both the horizontal and vertical stability of each type of dual-hook back plate hanger.

Although a hooked back plate support is most rigid and a multi-hook support provides an extended degree of stability for pegboard hangers, it was nevertheless found that such hangers would oten times lift from the pegboard by someone accidentally disturbing the hangers. Many times store personnel which use such hangers to display merchandise would, upon lifting merchandise from the support, inadvertently lift the pegboard hanger causing the hooks to be lifted from the pegboard openings resulting in the entire hanger assembly falling from the pegboard support.

Others have, in the past, made various attempts to produce means for preventing pegboard hangers from being inadvertently removed from the pegboard backing. For example, U.S. Pat. No. 3,193,231 provides a storage device which is affixed to a vertical pegboard surface 11. The storage device is affixed by means of pins 14 and 18. As shown in FIGS. 6 and 7, the pins may consist of sectioned cylinders which provide a spring clipping action. This patent does not show separate stabilizer means which can be used in conjunction with presently existing pegboard hangers, although the need for some type of stabilization between hangers and pegboards was well recognized. A similar disclosure can be found in U.S. Pat. No. 3,452,954 which, again, utilizes a split peg spring action to stabilize the pegboard hanger. U.S. Pat. No. 3,037,732 does show a stabilizer for pegboard hangers which can be used on existing hangers as a means of positively stabilizing the devices. The present invention, however, is considered to be a distinct improvement over the device disclosed in U.S. Pat. No. 3,037,732 for that device, unlike the present invention which will be described hereinafter, has no positive locating means for lining up the stabilizer with a pegboard opening, requires two hands to remove the stabilizer from the pegboard, is of such a configuration as to seriously damage the pegboard opening when the stabilizer is repetitively inserted and removed and prevents the direct frontal insertion and removal of the hanger onto and from the pegboard. This latter point becomes important when using hangers of extended length, i.e., 4 inches or more, under an existing shelf or when articles are hanging above.

The invention described in U.S. patent application Ser. No. 089,034 was taught as being capable of being used with single and multi-hook back plate hangers which have current widespread acceptance. Thus, the stabilizer of applicant's parent application was taught to be capable of being readily adapted to currently available hanger devices. By contrast, applicant's present invention provides a simple and inexpensive means of providing, in a single unitary pegboard hanger, both the hanger means as well as the hook means and stabilizing protrusion.

It is an object of the present invention to provide a unitary pegboard hanger assembly having none of the disadvantages of prior art devices.

It is yet another object of the present invention to provide a unitary pegboard hanger assembly which can be easily inserted and removed from a pegboard panel without undue effort and without harming said panel.

These and other objects of the present invention are accomplished by providing a unitary pegboard hanger assembly comprising a hanger protruding perpendicularly from a hook back plate, a hook member protruding on the opposite side thereof as the hanger, at least one protrusion perpendicular to the hook back plate on the same side thereof as the hook member and proximate thereto, and further characterized as being of such size and shape as to snugly fit into a pegboard hole together with the hook member. Optionally, the unitary pegboard hanger assembly can possess a protrusion having a split lug configuration as well as tab means proximate the protrusion to aid in the removal of the unitary pegboard hanger from the pegboard.

The present invention can be more fully appreciated by considering the appended drawing wherein:

FIG. 1 is an isometric view of the unitary pegboard hanger assembly of the present invention.

The appended FIGURE shows the unitary pegboard hanger assembly of the present invention in its preferred embodiment. The assembly can be constructed of a unitary hook back plate 1 having attached thereto a hanger which, for the purpose of this illustration, is comprised of a single rod 10, which is bent to support price tag holder 12. The hanger can be connected to the unitary pegboard hanger by means of a snap-fit arrangement, as shown in U.S. Pat. No. 3,452,954. Alternatively, the unitary pegboard hanger assembly can be injection molded out of a single piece of plastic with hanger 10 as an integral part of the hook plate section. Also, the hanger 10 can be fabricated of plastic and ultrasonically welded to plastic back plate 1.

The present invention comprises a unitary pegboard hanger assembly 1 comprising a hanger 10 protruding perpendicularly from hook back plate 50 and, on the opposite side thereof, hook members, such as 8A, 8B, 9A (not shown) and 9B which are fabricated to support the structure within pegboard openings. Although the FIGURE shows a four-hook back plate member, the present invention is equally useful in a one or two-hook arrangement.

On the same side of the hook back plate as the hook members and proximate thereto are configured protrusions 3A and 3B perpendicular to the hook back plate and proximate to hook members 8A and 8B, which are further characterized as being of such size and shape as to snugly fit into a pegboard hole (not shown) with the hook members.

The unitary pegboard hanger assembly of the present invention is capable of being easily inserted within a pegboard hole and will result in preventing the hanger assembly from being removed from the pegboard inadvertently. Also, the unitary pegboard hanger assembly can be readily removed from engagement with the pegboard and hanger by merely placing finger pressure behind tabs 1A, 1B, which are ideally located proximate the protrusions 3A, 3B, respectively. Thus, it is a specific design feature of the present invention to present a unitary pegboard hanger assembly which can easily be inserted and removed from its stabilizing engagement with the pegboard panel. As shown in the appended FIGURE, protrusions 3A and 3B can preferably be of a split lug configuration providing for more convenient insertion and removal into the pegboard openings.

Standard pegboards are generally of ¼ or 3/16 inch in thickness. If the unitary pegboard hanger assembly is constructed for ¼ inch pegboard, its use on 3/16 inch pegboard will result in a less than snug fit. To compensate for this eventuality, the present invention, as a further optional preferred embodiment, is constructed to possess gap flap 60. As shown in the FIGURE, gap flap 60 and body section 50 froms a single plane which adapts the present invention for use with ¼ inch pegboard. However, when gap flap 60 is bent along hinge 65 for use with 3/16 inch pegboard, a snug fit is insured.

What is claimed is:

1. A unitary pegboard hanger assembly comprising a hanger protruding perpendicularly from a hook back plate, a hook member protruding on the opposite side thereof as the hanger, at least one protrusion perpendicular to the hook back plate on the same side thereof as the hook member and proximate thereto, and further characterized as being of such size and shape as to snugly fit into a pegboard hole together with the hook member and whereby the unitary pegboard hanger assembly further comprises a gap flap for snugly engaging said hook back plate with said pegboard when said pegboard is 3/16 inch in thickness and which forms a unitary plane with the hook back plate when the pegboard is ¼ inch in thickness.

* * * * *